US009885134B2

(12) United States Patent
Hayashi et al.

(10) Patent No.: US 9,885,134 B2
(45) Date of Patent: Feb. 6, 2018

(54) BULK RECOVERY APPARATUS FOR NONWOVEN FABRIC AND BULK RECOVERY METHOD FOR THE SAME

(71) Applicant: UNICHARM Corporation, Ehime (JP)

(72) Inventors: Tomoki Hayashi, Kagawa (JP); Hidetaka Oyama, Kagawa (JP); Jun Okuda, Kagawa (JP); Satoshi Mitsuno, Kagawa (JP)

(73) Assignee: UNICHARM CORPORATION, Ehime (JP)

( * ) Notice: Subject to any disclaimer, the term of this patent is extended or adjusted under 35 U.S.C. 154(b) by 5 days.

(21) Appl. No.: 15/030,040

(22) PCT Filed: Oct. 6, 2014

(86) PCT No.: PCT/JP2014/076717

§ 371 (c)(1),
(2) Date: Apr. 15, 2016

(87) PCT Pub. No.: WO2015/056596

PCT Pub. Date: Apr. 23, 2015

(65) Prior Publication Data

US 2016/0237608 A1 Aug. 18, 2016

(30) Foreign Application Priority Data

Oct. 18, 2013 (JP) ..... 2013-217197

(51) Int. Cl.
*D06C 7/00* (2006.01)
*D06B 5/08* (2006.01)
*D04H 1/70* (2012.01)

(52) U.S. Cl.
CPC ..... *D06C 7/00* (2013.01); *D04H 1/70* (2013.01); *D06B 5/08* (2013.01)

(58) Field of Classification Search
CPC ... D06C 3/00; D06C 3/06; D06C 7/00; D06C 7/02; D06C 2700/09; F26B 3/04;
(Continued)

(56) References Cited

U.S. PATENT DOCUMENTS 1,670,991 A * 5/1928 Schilde ..... D06C 7/00 34/223
2,700,226 A * 1/1955 Dungler ..... D06C 7/00 34/656

(Continued)

FOREIGN PATENT DOCUMENTS

CN 1134479 A 10/1996
CN 1407305 4/2003

(Continued)

OTHER PUBLICATIONS

International Search Report in PCT/JP2014/076717, dated Dec. 22, 2014.

(Continued)

*Primary Examiner* — Amy Vanatta
(74) *Attorney, Agent, or Firm* — Hauptman Ham, LLP

(57) ABSTRACT

An apparatus for recovering bulkiness of a nonwoven fabric by blowing hot air and heating the nonwoven fabric transferred in a transfer direction, includes a case member that has both end portions in the transfer direction opened; an entrance and an exit provided to openings on opposite end sides, in the transfer direction, of the case member to transfer the nonwoven fabric; a wall surface along the transfer direction and located between the entrance and the exit; a blast opening in the wall surface for blasting hot air inside the case member in a blasting direction being the transfer direction or opposite to the transfer direction; and a discharge opening provided to the case member and downstream in the blasting direction. Hot air flows from the blast opening toward the discharge opening while coming into (Continued)

contact with one of two faces of the nonwoven fabric inside the case member.

12 Claims, 5 Drawing Sheets

(58) Field of Classification Search
CPC ..... F26B 13/06; F26B 13/08; F26B 13/005; F26B 13/108; F26B 13/12; F26B 13/103; F26B 13/104; F26B 21/00; F26B 21/04; D06B 1/02; D06B 1/08; D06B 5/08; D06B 5/02; D06B 21/00; D06B 23/14; D02J 1/12; D04H 1/50; D04H 1/54
USPC ..... 28/167; 26/106; 68/5 D, 5 E; 34/580, 34/590, 620, 636
See application file for complete search history.

(56) References Cited

U.S. PATENT DOCUMENTS 3,577,652 A * 5/1971 Evans ..... F26B 13/10 34/636
3,662,476 A * 5/1972 Capizzi ..... F26B 13/104 34/643
4,342,718 A * 8/1982 Caratsch ..... B29C 35/06 264/136
4,833,794 A * 5/1989 Stibbe ..... F26B 13/104 101/424.1
4,952,145 A * 8/1990 Kwiatkowski ..... B29C 35/06 126/92 AC
7,004,753 B2 * 2/2006 Stockhausen ..... D01F 9/32 34/444
2004/0111848 A1 * 6/2004 Miyamoto ..... A61F 13/15699 28/165
2011/0191994 A1 * 8/2011 Takahashi ..... D04H 1/498 28/167
2015/0067996 A1 * 3/2015 Okuda ..... D04H 1/50 26/106

FOREIGN PATENT DOCUMENTS

| | | | |
|---|---|---|---|
| CN | 1497086 | A | 5/2004 |
| CN | 102227528 | A | 10/2011 |
| JP | 2004-137655 | A | 5/2004 |
| JP | 2009-155756 | A | 7/2009 |
| JP | 2012-97087 | A | 5/2012 |
| WO | 2010/047292 | A1 | 4/2010 |
| WO | 2013/157611 | A1 | 10/2013 |

OTHER PUBLICATIONS

Written Opinion in International Patent Application No. PCT/JP2014/076717, dated Dec. 22, 2014.

* cited by examiner

BULK RECOVERY APPARATUS FOR NONWOVEN FABRIC AND BULK RECOVERY METHOD FOR THE SAME

RELATED APPLICATIONS

The present application is a National Phase entry of International Application No. PCT/JP2014/076717, filed Oct. 6, 2014, which claims priority of Japanese Application No. 2013-217197, filed Oct. 18, 2013.

TECHNICAL FIELD

The present invention relates to a bulk recovery apparatus for nonwoven fabric and a bulk recovery method for nonwoven fabric.

BACKGROUND ART

Sanitary napkins and disposable diapers have been conventionally used as absorbent articles. And pee pads for pets included within the category of the above absorbent articles are also widely used as toilets for pets. A liquid permeable top sheet is provided to the part of such absorbent articles which contacts such as the user's skin. And recently, bulky nonwoven fabric is preferred as the material of the top sheet since a high capturing performance is required from the viewpoint of reducing the sticky touch felt by the skin.

Such nonwoven fabric is manufactured in a strip form by appropriate methods such as the carding method, and are wound in a rolled form thereafter to be stored in states of nonwoven fabric rolls. And the nonwoven fabric roll is brought to the absorbent article manufacturing line when the nonwoven fabric is to be used, then the nonwoven fabric is unrolled from the above nonwoven fabric roll at the above manufacturing line to be used as the material for the top sheet.

Meanwhile, tensile force in the winding direction is applied in order to avoid the nonwoven fabric from meandering and the like when winding the nonwoven fabric into a roll of nonwoven fabric. For such reason, the nonwoven fabric is usually wound tightly by this tensile force. In other words, this nonwoven fabric is compressed in the thickness direction to be in a state such that the bulkiness is reduced. Therefore, only nonwoven fabric with its bulk reduced would be unrolled and provided when the nonwoven fabric is unrolled from the nonwoven fabric roll at the absorbent article manufacturing line, that is, the aforementioned requirement of a bulky nonwoven fabric would not be met.

There is known, as a method of increasing the bulk of nonwoven fabric, a process such as blowing hot air against the surface of the nonwoven fabric to heat the surface of the nonwoven fabric so that the fibers of the compressed nonwoven fabric would return to its initial state. PTL 1 discloses, for example, a method of preparing a heating chamber for heating nonwoven fabric and blowing hot air into either the entrance side or the exit side when the nonwoven fabric is transferred from the entrance side to the exit side of the heating chamber. The hot air blown into the heating chamber is discharged from the other side of the entrance or the exit so to flow along the surface of the nonwoven fabric in the heating room allowing the nonwoven fabric to recover its bulk.

CITATION LIST

Patent Literature

[PTL 1] Japanese Laid-open Application No. 2012-097087

SUMMARY OF INVENTION

Technical Problem

The bulk recovery apparatus heats the nonwoven fabric to soften the nonwoven fabric. Therefore, the nonwoven fabric can easily stretch in the transfer direction when tensile strength in the transfer direction acts thereagainst. Meanwhile, nonwoven fabric with a low melting point is likely to stretch whereas nonwoven fabric with a high melting point is unlikely to stretch under the same heating condition since the melting points of the nonwoven fabrics differ according to their materials. Therefore, the amount of stretching of the nonwoven fabric needs to be brought to an appropriate state by adjusting the amount of hot air flow which is blown into the bulk recovery apparatus, in this case.

However, with the configuration disclosed in PTL 1, the orifice size of the nozzle for blowing in hot air is limited by the entrance size or the exit size of the heating chamber since the nozzle is arranged to the entrance or the exit of the heating chamber and therefore the range in which the hot air flow rate can be adjusted was narrow.

The present invention has been made in view of the above circumstances and an objective thereof is to widen the range in which the hot air flow rate can be adjusted in a bulk recovery apparatus.

Solution to Problem

A main aspect of the invention for achieving the above objective is an apparatus that recovers a bulk of a nonwoven fabric by blowing hot air and heating the nonwoven fabric that is transferred in a transfer direction, including a case member that has both end portions thereof in the transfer direction opened; an entrance, that is provided to an opening on one end side, in the transfer direction, of the case member, the entrance being used to transfer the nonwoven fabric; an exit that is provided to an opening on an other end side, in the transfer direction, of the case member, the exit being used to transfer the nonwoven fabric; a wall surface that is along the transfer direction and is located between the entrance and the exit of the case member; a blast opening that is provided to the wall surface and blasts into a space inside the case member the hot air in a direction in the transfer direction or a direction opposite the transfer direction; and a discharge opening that is provided to the case member, at a part on a downstream side of a direction in which the hot air is blasted, the discharge opening being made to discharge the hot air from the space inside the case member, wherein the hot air flows from the blast opening toward the discharge opening while coming into contact with one face of two faces of the nonwoven fabric in the space inside the case member.

Other features of the present invention will be made clear through the present specification with reference to the accompanying drawings.

Advantageous Effects of Invention

According to the present invention, the range in which the hot air flow rate can be adjusted in a bulk recovery apparatus can be widened.

DESCRIPTION OF EMBODIMENTS

Figure 1A:
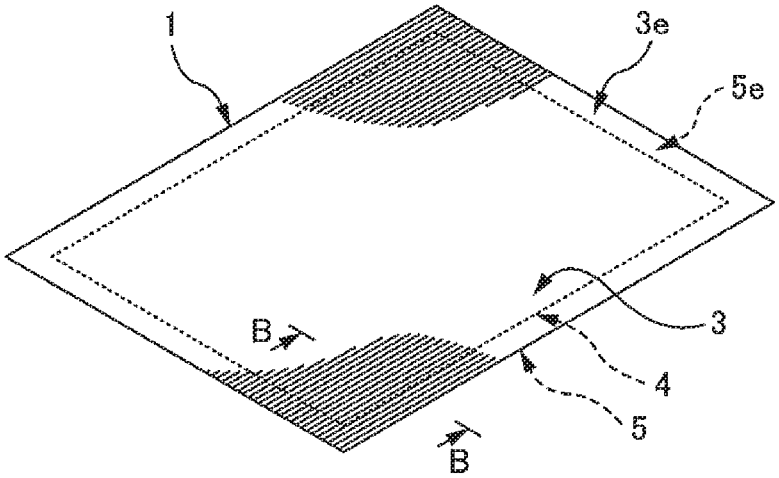
FIG. 1A is an external perspective view illustrating a pee pad 1 as an example of an absorbent article.

At least the following matters will become clear through the description of the present specification and the accompanying drawings.

An apparatus that recovers a bulk of a nonwoven fabric by blowing hot air and heating the nonwoven fabric that is transferred in a transfer direction, including a case member that has both end portions thereof in the transfer direction opened; an entrance, that is provided to an opening on one end side, in the transfer direction, of the case member, the entrance being used to transfer the nonwoven fabric; an exit that is provided to an opening on an other end side, in the transfer direction, of the case member, the exit being used to transfer the nonwoven fabric; a wall surface that is along the transfer direction and is located between the entrance and the exit of the case member; a blast opening that is provided to the wall surface and blasts into a space inside the case member the hot air in a direction in the transfer direction or a direction opposite the transfer direction; and a discharge opening that is provided to the case member, at a part on a downstream side of a direction in which the hot air is blasted, the discharge opening being made to discharge the hot air from the space inside the case member, wherein the hot air flows from the blast opening toward the discharge opening while coming into contact with one face of two faces of the nonwoven fabric in the space inside the case member.

According to such a bulk recovery apparatus for nonwoven fabrics, the sectional area of the exit part of the blast opening can be changed freely since the size of the hot air blast opening is not limited. Hereby, the range in which the hot air flow rate can be adjusted can be widened.

It is preferable that in the nonwoven fabric bulk recovery apparatus, a sectional area of the blast opening is wider than a sectional area having a normal direction thereof come along the transfer direction of the hot air flowing in the space at an interior of the case member.

According to such a bulk recovery apparatus for nonwoven fabrics, the air flow is prevented from becoming too fast even when the air flow of the hot air blasted out from the blast opening is increased, and the deterioration of energy efficiency is also reduced. Therefore, the nonwoven fabric bulk recovery can be performed efficiently since the adjustment range of the hot air flow can be set widely.

It is preferable that in the nonwoven fabric bulk recovery apparatus, the blast opening is provided to a part of the entrance of the case member, the discharge opening is provided to a part of the exit of the case member, and the hot air is blasted to flow from an upstream side along the transfer direction toward a downstream side along the transfer direction.

According to such a bulk recovery apparatus for nonwoven fabrics, the hot air moves in a manner flowing along the surface of the nonwoven fabric which is transferred in the transfer direction so that the hot air compressing this nonwoven fabric in the thickness direction of the nonwoven fabric is effectively prevented and thus the bulk can recover smoothly.

It is preferable that in the nonwoven fabric bulk recovery apparatus, a direction in which the hot air is blasted forms an angle that is 30 degrees or less with respect to the transfer direction.

According to such a bulk recovery apparatus for nonwoven fabrics, the angle formed between the direction in which the hot air is blasted and the nonwoven fabric transfer direction is made small as possible such that the blasted hot air can flow easily along the surface of the nonwoven fabric and thus the bulk of the nonwoven fabric can recover efficiently.

It is preferable that in the nonwoven fabric bulk recovery apparatus, a shape, of a wall surface on the downstream side along the transfer direction, of a wall surface that forms the blast opening has a curved surface configured with curved lines having a center of curvature thereof located on an opposite side of a surface that contacts the hot air, and a tangential direction of the curved surface at a location of the blast opening forms the angle that is 30 degrees or less with respect to the transfer direction.

According to such a bulk recovery apparatus for nonwoven fabrics, the tangential direction of the wall surface and the transfer direction of the nonwoven fabric can be made close to parallel at the blast opening position since the hot air flows in a manner being guided along the wall surfaces forming the blast opening. Hereby, the angle between the direction in which the hot air is blasted and the nonwoven fabric transfer direction is made small thereby allowing the bulk of the nonwoven fabric to recover efficiently.

It is preferable that the nonwoven fabric bulk recovery apparatus further includes a hot air supply device that supplies the hot air into the case member, wherein the hot air supply device recovers the hot air discharged from the discharge opening to resupply into the case member.

According to such a bulk recovery apparatus for nonwoven fabrics, some energy can be reused while suppressing negative effects to other proximate semimanufactured goods when the hot air is discharged from the case member.

Further, there will be made clear a method of recovering a bulk of a nonwoven fabric by blowing hot air and heating the nonwoven fabric that is transferred in a transfer direction, including: when an entrance is provided to an opening on one end side in the transfer direction to transfer the nonwoven fabric and an exit is provided to an opening on an other end side in the transfer direction to transfer the nonwoven fabric, in a case member that has both end portions thereof in the transfer direction opened, blasting in a direction in the transfer direction or a direction opposite the transfer direction and into a space inside the case member the hot air from a blast opening that is provided to a wall surface that is along the transfer direction and located between the entrance and the exit of the case member; discharging the hot air from the space inside the case member from a discharge opening that is provided to the case member, at a part on a downstream side along a direction in which the hot air is blasted; and allowing the hot air to flow from the blast opening toward the discharge opening while coming into contact with one face of two faces of the nonwoven fabric in the space inside the case member.

According to such a bulk recovery method for nonwoven fabrics, the adjustable range of the hot air flow rate can be widened.

Embodiment

<Nonwoven Fabric as Target of Bulk Recovery>

The bulk recovery apparatus 20 and the bulk recovery method for nonwoven fabric 3 according to the present embodiment aims to processes the nonwoven fabric 3 which becomes the top sheet 3 of the pee pad 1 for pets.

Figure 1B:
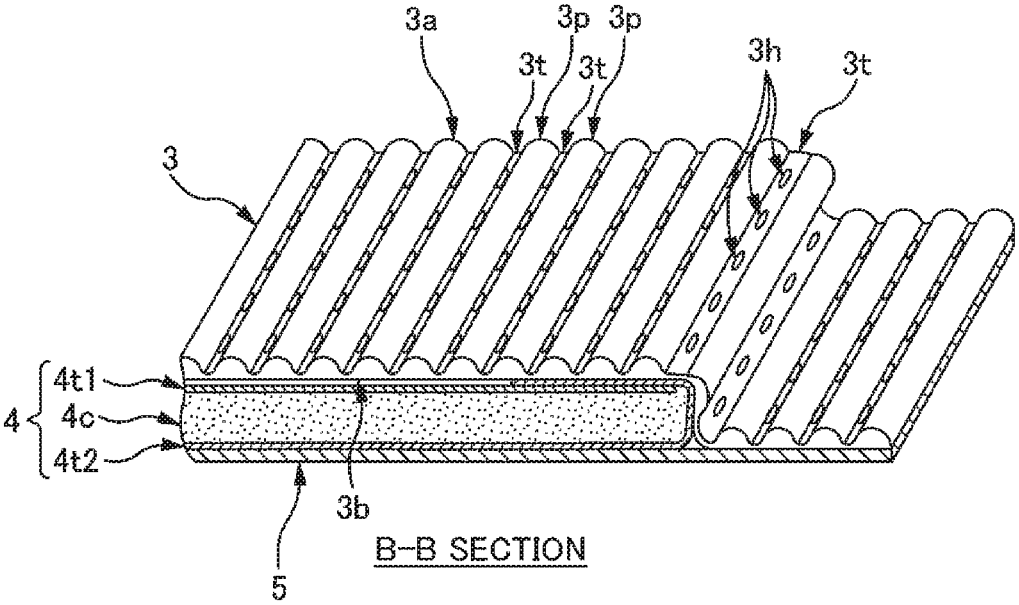
FIG. 1B is an enlarged perspective view when the pee pad 1 is cut along line B-B of FIG. 1A.

FIG. 1A is an external perspective view illustrating a pee pad 1 as an example of an absorbent article and FIG. 1B is an enlarged perspective view when the pee pad 1 is cut along line B-B of FIG. 1A.

The pee pad 1 is used to catch excrement of animals such as dogs and cats and is used by placing the pee pad 1 on the floor and the like, as illustrated in FIG. 1A. This pee pad 1 includes, for example, a liquid permeable top sheet 3 in a rectangular shape when seen in a planar view, a liquid impermeable back sheet 5 in approximately the same shape as the top sheet 3, and a liquid absorptive absorbent body 4 which is inserted between these sheets 3 and 5. And the absorbent body 4 is adhered to both the top sheet 3 and the back sheet 5 using hot melt adhesives and the like. Further, the top sheet 3 and the back sheet 5 are adhered with hot melt adhesives and the like at the parts 3*e* and 5*e* which extend out sideward from the absorbent body 4, that is, the outer circumferential edges 3*e* and 5*e* of the sheets 3 and 5.

As illustrated in FIG. 1B, the absorbent body 4 includes an absorbent core 4*c* which is formed by layering, for example, liquid absorbent fiber such as pulp fiber and super absorbent polymer (so-called SAP) in a substantially rectangular form when seen in a planar view. This core 4*c* may be covered with two liquid permeable covering sheets 4*t*1, 4*t*2 such as tissue paper as in this example. In other words, the core 4*c* is covered with one covering sheet 4*t*1 on the skin side face and with another covering sheet 4*t*2 on the non-skin side face. Note that, a single covering sheet may cover the entire absorbent core 4*c* in some cases.

The back sheet 5 is, for example, a film material such as polyethylene (hereinafter, PE), polypropylene (hereinafter, PP), polyethylene terephthalate (hereinafter, PET) and the like. However, it is not limited to such and any liquid permeable sheet may be used.

The top sheet 3 is made of a nonwoven fabric 3 material. In this example, one face 3*b* of the two faces 3*a*, 3*b* of the nonwoven fabric is in an approximately flat plane, but the other face 3*a* is in a corrugated shape. In other words, linear grooves 3*t* and linear bumps 3*p* are formed alternately. These bumps 3*p*, 3*p* . . . are formed by having the fibers originally existing at the grooves 3*t* blown sideways to be raised by a well known air blowing process (see such as Japanese Patent Application Laid-open Publication No. 2009-11179), with the fibers in loose states. And hereby, this nonwoven fabric 3 as a whole is made bulky. Further, a plurality of through holes 3*h*, 3*h* . . . penetrating in the thickness direction may be formed to the grooves 3*t*, as in this example.

The average basis weight of this nonwoven fabric 3 is, for example, 10 to 200 (g/m$^2$), the average basis weight at the center parts of the bumps 3*p* is, for example, 15 to 250 (g/m$^2$) and the average basis weight at the bottom portions of the grooves 3*t* is 3 to 150 (g/m$^2$).

Further, it is preferable that the fiber of the nonwoven fabric is a composite fiber type having a so-called core-sheath structure which is configured of a core and a sheath made of different materials, however, fiber having a side-by-side structure may be used or a single fiber type made of only thermoplastic resin may be used. The properties of the nonwoven fabric 3 will differ depending on the members configuring the nonwoven fabric 3 when the fiber thereof is a composite fiber type made of a core-sheath structure, and this will be explained later.

Furthermore, the nonwoven fabric 3 may include crimped fiber. Here, crimped fiber is fiber in a crimped form such as a wavy form, a pinched form, a helical form and the like.

And the fiber length of the fibers included in the nonwoven fabric 3 is selected from the range of, for example, 20 to 100 mm and the fineness is selected from the range of, for example, 1.1 to 8.8 (dtex).

<Description of the Bulk Recovery Apparatus>

The pee pad 1 is manufactured in a pee pad 1 manufacturing line and the nonwoven fabric 3 used as the top sheet 3 is brought into this manufacturing line in a nonwoven fabric roll 3R (FIG. 2) form. In other words, the nonwoven fabric 3 having the aforementioned bumps 3*p* is stored once rolled in a roll form and then the nonwoven fabric roll 3R is brought from the storage to the pee pad 1 manufacturing line. Thereafter, the nonwoven fabric 3 is mounted to the supply device 35 equipped to this manufacturing line to be supplied as the material for the top sheet 3.

However, as aforementioned, there is a possibility that the bulk of the nonwoven fabric 3 would be flattened when in the nonwoven fabric roll 3R. For such reason, this manufacturing line is provided with a bulk recovery apparatus 20.

Figure 2:
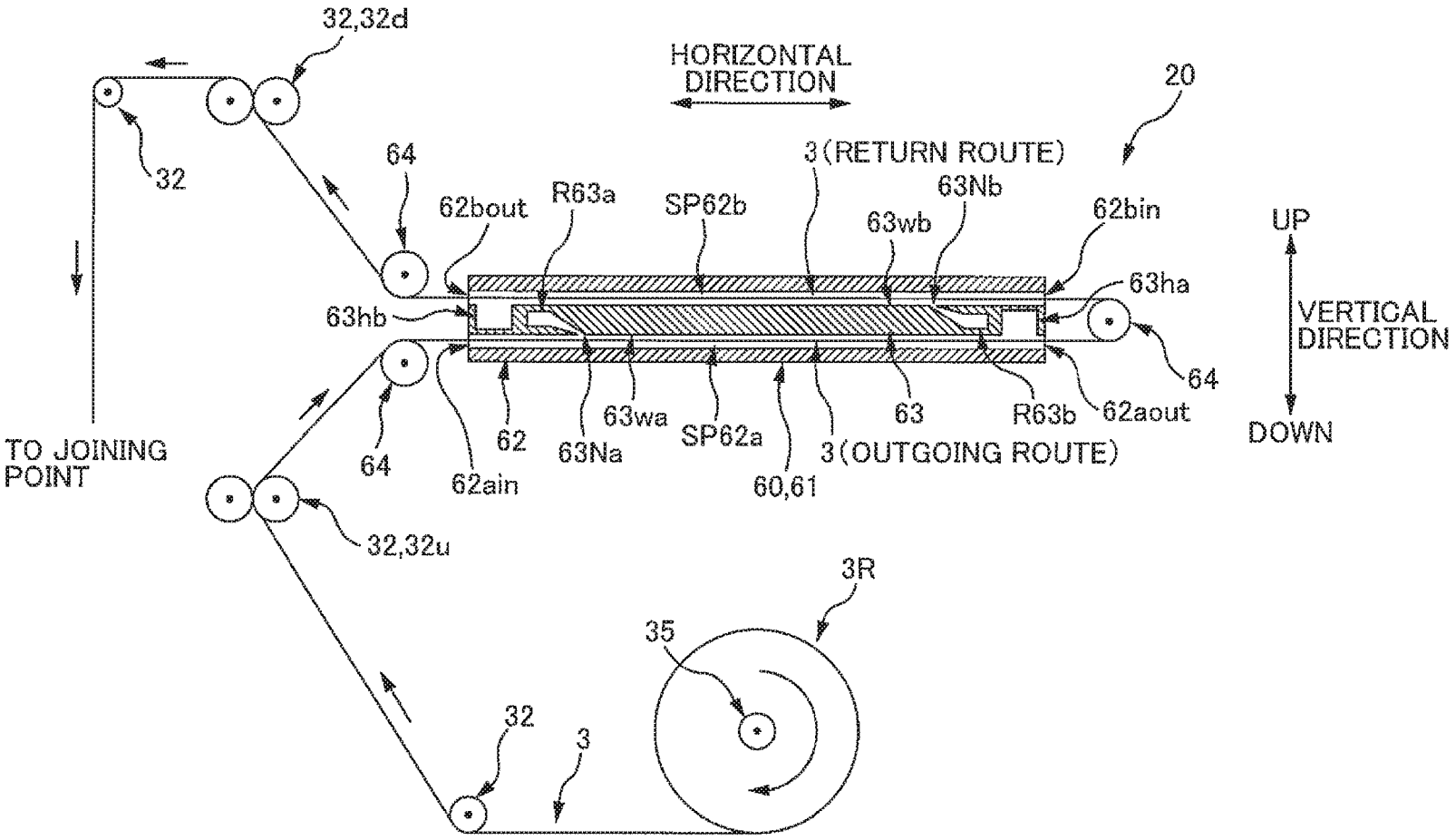
FIG. 2 is a schematic side view illustrating the bulk recovery apparatus 20 according to the present embodiment.
Figures 3A, 3B:
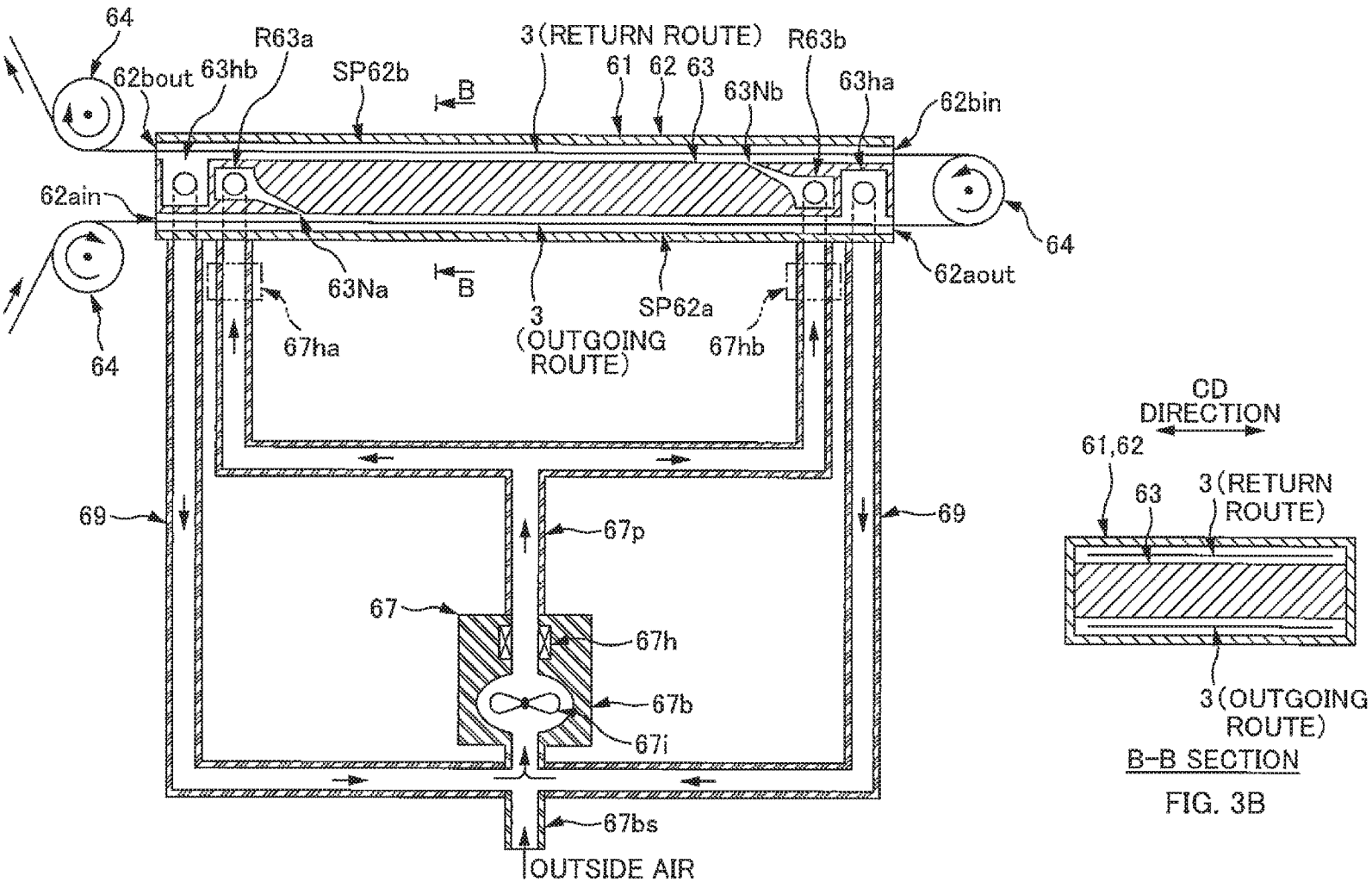
FIG. 3A is an explanatory view of a heating portion 60 configuring the main portion of the bulk recovery apparatus 20.
FIG. 3B is a sectional view taken along line B-B of FIG. 3A.

FIG. 2 is a schematic side view of the bulk recovery apparatus 20. FIG. 3A is an explanatory view of a heating portion 60 configuring the main portion of the bulk recovery apparatus 20 and FIG. 3B is a sectional view taken along line B-B of FIG. 3A. Here, FIGS. 2 and 3A show sectional views of the heating unit 61 configuring the main portion of the heating portion 60.

As illustrated in FIG. 2, the bulk recovery apparatus 20 includes a transfer portion 30 which rolls out the nonwoven fabric 3 from the nonwoven fabric roll 3R to be transferred along a predetermined transfer path, a heating portion 60 which heats the nonwoven fabric 3 at a predetermined location on the transfer path, and a controller (not shown) which controls the transfer portion 30 and the heating portion 60. And the nonwoven fabric 3 which was heated with the heating portion 60 to have the bulk recovered is sent to the point where nonwoven fabric joins the other semi-manufactured goods relating to the pee pad 2, such as the absorbent body 4, located on the downstream side along the transfer direction, and is joined with the above semimanufactured good at this joining point.

By the way, similar to the bulk recovery apparatus 20, the various devices (not shown) on the manufacturing line are arranged on this line supported by an appropriate support member. And in this example, a so-called faceplate (not shown) is used as an example of this support member. The faceplate is a plate member provided to stand vertically on the floor portion of the manufacturing line and this faceplate includes a vertical plane (a plane whose normal direction faces the horizontal direction) and the various devices are supported by this vertical plane in for example, a cantilevered state.

And in the following description, the direction normal to this vertical plane will be called the "CD direction". Here in FIG. 2, the CD direction is directed in the direction which penetrates the plane of the paper of FIG. 2 and to be specific, the CD direction is directed in the direction that penetrates the plane of the paper of FIG. 2, among any direction which is in the horizontal plane. And since the nonwoven fabric 3 which has been rolled out is basically transferred in a position having the width direction of the nonwoven fabric 3 facing the CD direction, the transfer direction of the nonwoven fabric 3 would be directed in any direction which is orthogonal to the CD direction. It should be noted that the support member is not limited to the faceplate and other support members may be used.

(Transfer Portion 30)

The transfer portion 30 includes a plurality of transfer rollers 32, 32 . . . which define the transfer path of the nonwoven fabric 3 and a supply device 35.

The transfer rollers 32, 32 . . . are rotatably supported about the rotating shaft which comes along the CD direction and hereby the nonwoven fabric 3 is transferred in a position having the width thereof facing the CD direction. Some of the transfer rollers 32, 32 among the transfer rollers 32, 32 . . . are drive rollers 32*u*, 32*d* which are driven to rotate with the servo motor which acts as the drive source. And the other rollers 32, 32 . . . are follower rollers which do not have a drive source in other words, are rollers that are rotated by the rotating force caused by coming into contact with the nonwoven fabric 3 being transferred.

The drive rollers 32*u*, 32*d* are provided to the positions on the two sides of the heating portion 60 (specifically, the later described heating unit 61) at the transfer path. And the transfer state of the nonwoven fabric 3 at the heating portion 60 can be adjusted by controlling the rotational movement of the upstream side drive transfer rollers 32*u* and the downstream side drive transfer rollers 32*d*.

The supply device 35 is a device which supplies the nonwoven fabric 3 from the nonwoven fabric roll 3R and includes a rotating shaft which is arranged along the CD direction. And the nonwoven fabric roll 3R is rotatably supported by this rotating shaft. The rotating shaft is driven to rotate by, for example, a servo motor (not shown) which serves as the drive source and hereby, the nonwoven fabric 3 is supplied from the nonwoven fabric roll 3R. Here, a plurality e.g. two) of the supply devices 35 may be provided to have a plurality (two) of the nonwoven fabric rolls 3R alternatively used by switching. That is, the configuration may be such that while one of the supply devices 35 is supplying the nonwoven fabric 3, the other supply device 35 is in a waiting state and when the nonwoven fabric roll 3R of the one of the supply devices 35 is used up the supply device 35 in a waiting state may start supplying the nonwoven fabric 3. Note that, the detailed description of this supply device 35 is omitted since the supply device 35 is well known.

Further, an accumulator device and a tension control device (both not shown) may be equipped, to the transfer portion 30, between the supply device 35 and the upstream side drive transfer roller 32*u*. The accumulator device is a device which deliverably accumulates toward the downstream along the transfer direction the nonwoven fabric 3 supplied by the supply device 35. For example, when one supply device 35 among the two supply devices 35 supplies all the nonwoven fabric 3 from the nonwoven fabric roll 3R and the supply device 35 stops when switching to the other supply device 35, the accumulator device itself delivering the accumulated nonwoven fabric 3 can avoid effects to the downstream caused by stopping the supply by the supply device 35. The tension control device is a device which adjusts to a predetermined target value (N) the tensility (N) of the nonwoven fabric 3 to be transferred.

(Heating Portion 60)

The heating portion 60 includes a heating unit 61 which blows hot air to heat the nonwoven fabric 3 to be transferred at the inside and a hot air supply device 67 which supplies hot air to this heating unit 61.

The heating unit 61 includes a case member 62 having both end sections along the longitudinal direction opened and a plurality of guide rollers 64, 64, 64 which are provided outside the case member 62 to allow the nonwoven fabric 3 to be guided and reciprocate inside the case member 62. And an outgoing route and a return route of the transfer path of the nonwoven fabric 3 are linearly formed inside the case member 62 by the guide rollers 64, 64, 64. Additionally, as illustrated in FIG. 3A, a partitioning member 63 which forms the wall surface along the transfer direction of the nonwoven fabric 3 is formed inside the case member. This partitioning member 63 (wall surface) sections the space inside the case member 62 into the outgoing route space SP62*a* and the return route space SP62*b*. In other words, the outgoing route space SP62*a* and the return route space SP62*b* are separated so that air cannot communicate between the two. Further, separation with this partitioning member 63 allows to have formed on one end portion of the two end portions in the longitudinal direction (i.e., transfer direction of nonwoven fabric 3) of the case member 62 both an outgoing route entrance 62*ain* for the nonwoven fabric 3 being transferred to enter and an return route exit 62*bout*. And the other end portion has formed both the outgoing route exit 62*aout* and the return route entrance 62*bin* for the nonwoven fabric 3. The nonwoven fabric 3 when being transferred by the transfer portion 30 enters into the interior (outgoing route space SP62*a*) of the case member 62 from the outgoing route entrance 62*ain* and exits from the exit 62*aout*. Similarly, the nonwoven fabric 3 when being transferred enters into the interior (return route space SP62*b*) of the case member 62 from the return route entrance 62*bin* and exits from the exit 62*bout*.

Of the two wall surfaces 63*wa*, 63*wb* of the partitioning member 63 the wall surface 63*wa* (hereinafter, outgoing route wall surface 63*wa*) which is adjacent to the outgoing route space SP62*a*, and of the two wall surfaces 63*wa*, 63*wb* the wall surface 63*wb* (hereinafter, return route wall surface 63*wb*) which is adjacent to the return route space SP62*b* are respectively arranged parallel to the transfer direction and the CD direction. Hereby, the outgoing route wall surface 63*wa* and the return route wall surface 63*wb* are respectively made substantially parallel with the faces of the nonwoven fabric 3. And the upstream side part along the transfer direction of the outgoing route in the outgoing route wall surface 63*wa* has provided thereto a blast opening 63Na in a slit form long in the CD direction and the upstream side part along the transfer direction of the return route in the return route wall surface 63*wb* also has provided thereto a blast opening 63Nb in a slit form long in the CD direction. And the blast opening 63Na blasts into the return route space SP62*b* hot air supplied from the pressure chamber R63*a* formed inside the partitioning member 63. Similarly, the blast opening 63Nb blasts into the outgoing route space SP62*b* hot air supplied from the pressure chamber R63*a* formed inside the partitioning member 63. Description of the hot air blasting operation will be given later.

Further, the downstream side part, at the outgoing route wall surface 63*wa*, along a direction in which hot air is blasted from the blast opening 63Na has provided thereto a discharge opening 63*ha* which opens to the outgoing route space SP62*a*. In the case of FIG. 3A, the discharge opening 63*ha* is provided further to the downstream side (corresponding to the "exit side part of case member") along the transfer direction with respect to the blast opening 63Nb and the pressure chamber R63*b* in the partitioning member 63. The hot air blasted from the blast opening 63Na made to flow along the transfer direction of the nonwoven fabric 3 is allowed to be discharged from the outgoing route space SP62*a* with this discharge opening 63*ha*. Similarly, the downstream side part, at the return route wall surface 63*wb*, along a direction in which hot air is blasted from the blast opening 63Nb has provided thereto a discharge opening 63*hb* which opens to the return route space SP62*b*. In the case of FIG. 3A, the discharge opening 63*hb* is provided further to the downstream side (corresponding to the "exit side part of case member") along the transfer direction with respect to the blast opening 63Na and the pressure chamber R63*a* in the partitioning member 63, and discharges the hot air blasted from the blast opening 63Nb to the return route space SP62*b*.

The hot air supply device 67 includes an air blower 67*b* and a heater 67*h*. And hot air is generated by heating with the heater 67*h* wind generated with the air blower 67*b*, and this hot air is supplied to the pressure chambers R63*a*, R63*b* of the partitioning member 63 inside the case member 62 of the aforementioned heating unit 61 through an appropriate tube member 67*p*. Thereafter, hot air is blasted out from the blast openings 63Na, 63Nb through the pressure chambers R63*a*, R63*b*.

The air blower 67*b* includes, for example, an impeller 67*i* which is rotated by using a motor as the drive source and an inverter (not shown) which adjusts the rotational speed (rpm) of the aforementioned motor. And hereby, the VVVF inverter control with the controller (not shown) can be performed so that as a result the air volume ($m^3$/min) can be adjusted to any value through changing of the rotational speed (rpm) of the impeller 67*i*.

Here, as illustrated in FIG. 3A, the heater 67*h* may be built-in the air blower 67*b* or may be provided outside the air blower 67*b*. When the heater 67*h* is provided outside, it is preferable to arrange the heaters 67*ha*, 67*hb* proximate the case member 62 of the heating unit 61, as virtually illustrated using chain double-dashed lines in FIG. 3A, and hereby the responsiveness can be improved when adjusting the temperature of the hot air. And in this case, it is further preferable to provide the heaters 67*ha*, 67*hb* to each of the blast openings 63Na, 63Nb. In other words, it is preferable to provide the heater 67*ha* to correspond to the outgoing route blast opening 63Na, and separate from this, the heater 67*hb* is provided to correspond to the return route blast opening 63Nb. Hereby, the temperature of the hot air can be adjusted for each of the blast openings 63Na, 63Nb so that the setting conditions of the bulk recovery process can be finely performed as a result.

Here, an electric heater which heats using electricity (kW) can be employed as the above heaters 67*h*, 67*ha*, 67*hb*. However, it is not limited to such and any device may do as long as it can heat air which forms wind.

And in this example, the "wind" indicates flows of air but includes in a broad sense, flows of gas such as nitrogen gas and inactive gas besides flows of air. In other words, nitrogen gas and the like may be blown out from the blast openings 63Na, 63Nb.

Further in the present embodiment, each exit portion of the discharge openings 63*ha*, 63*hb* has one end sides of the recovery tube member 69 connected and the other end sides of the recovery tube member 69 communicate with the suction side part 67*bs* of the air blower 67*b*. Hereby, the hot air flowing through the spaces SP62*a*, SP62*b* are recovered to be returned to the suction side part 67*bs* of the air blower 67*b*. The recovered hot air is heated with the heater 67*h* by applying outside air and then supplied again to the heating unit 61. Recovery of the hot air allows reusing of a part of the energy while suppressing negative effects to the other proximate semimanufactured products when the hot air is discharged in the heating unit 61.

By the way, in the case of FIG. 3A, a foreign matter such as fiber waste and the like of the nonwoven fabric 3 has a possibility of being sent through the recovery tube member 69 and to the heater 67*h* inside the air blower 67*b* to melt thereto. Therefore, it is preferable that for example, a predetermined meshed filter member for preventing foreign matters to be drawn in is inserted between the suction side part 67*bs* of the air blower 67*b* and the recovery tube member 69. It is preferable that a similar kind of filter member is provided to also the suction side part 67*bs* in the example in FIG. 3A since there is a possibility that foreign matters such as paper dust in the manufacturing line may be mixed with outside air to be drawn in from the suction side part 67*bs*.

The heating unit 61 in the examples of FIGS. 2 and 3 is a horizontal-mount type with the lengthwise direction of the case member 62 being directed along the horizontal direction and hereby, the outgoing route and the return route of the transfer path of the nonwoven fabric 3 are arranged horizontally, however, it is not limited to such. In other words, the heating unit 61 may be a vertical-mount type. To be specific, the lengthwise direction of the case member 62 may be directed in the vertical direction to thereby allow the outgoing route and return route of the transfer path of the nonwoven fabric 3 to be arranged vertically. And furthermore, the lengthwise direction of the case member 62 may be arranged inclined from the vertical direction and the horizontal direction according to the layout circumstances. However, the vertical-mount type is excellent since the planar area required for placing the heating unit 61 is small.

<Operation of Hot Air Blasting>

Figure 4:
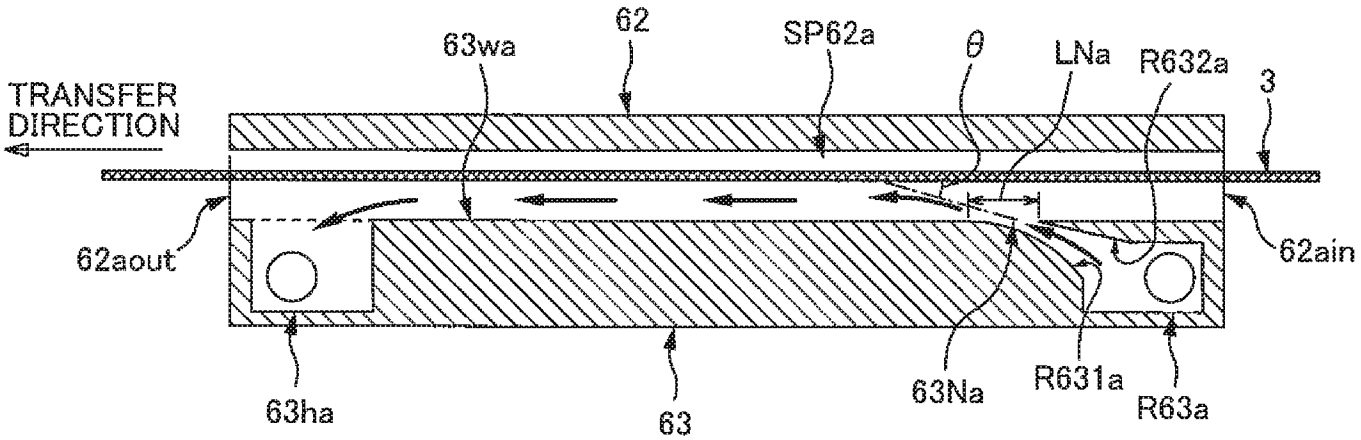
FIG. 4 is a schematic view explaining the hot air flow at the interior of the case member 62.

The hot air flow inside the case member 62 of the heating unit 61 and the bulk recovery operation of the nonwoven fabric 3 will be specifically described with reference to the figures. FIG. 4 is a schematic view explaining the hot air flow inside the case member 62. Although FIG. 4 illustrates only the outgoing route space SP62*a*, the return route space SP62*b* has a similar configuration as the outgoing route space SP62*a*, and the way in which the hot air flows and the bulk recovery operation of the nonwoven fabric 3 are the same. Therefore, description of the outgoing route space SP62*a* will be given in the following and description of the return route space SP62*b* will be omitted.

Firstly, the hot air supplied from the hot air supply device 67 is supplied to the pressure chamber R63*a* provided to the partitioning member 63. The sectional shape (the shape at the section having the normal direction thereof directed in the CD direction) of the pressure chamber R63*a* is in a tapered shape becoming substantially narrower toward the downstream side of the transfer direction with the wall surface R631*a* and the wall surface R631*b*, and the pressure chamber R63*a* comes into communication with the outgoing route space SP62*a* at the tip end portion of the tapered shape so to thereby allow the tip end portion function as the aforementioned blast opening 63Na.

According to such blast opening 63Na, hot air is blasted toward the downstream side along the transfer direction and is directed to form an acute angle θ with respect to one of the two surfaces of the nonwoven fabric 3. It is preferable that the angle θ of the hot air blasting direction with respect to the transfer direction of the nonwoven fabric 3 at the location of the blast opening 63Na is within the range of 0 to 30 degrees and more preferably within the range of 0 to 10 degrees (see FIG. 4.) In other words, the blasted hot air is likely to flow along the surface of the nonwoven fabric 3 by making small as possible the angle formed with the hot air blasting direction and the nonwoven fabric 3 transfer direction. For such reason, as illustrated in FIG. 4, the wall surface R631*a* (the wall surface of the wall surfaces R631*a*, R631*b* which is positioned on the downstream side along the transfer direction) which forms the blast opening 63Na may be in a curved surface form. Specifically, the curved surface form may be such that the surface to which the hot air comes into contact is convexed at the wall surface R631*a*. In other words, the curved surface form is configured by curved lines having the center of curvatures at the opposite side (i.e., inside the partitioning member 63) of the face that comes into contact with the hot air. Since the hot air flows to be guided along the wall surface R631*a* when moving from the pressure chamber R63*a* to the blast opening 63Na side, the blasting direction of this hot air when being blasted from the blast opening 63Na to the space SP62*a* will be in a tangential direction to the wall surface R631*a*. Therefore, it is preferable that the wall surface R631*a* is in a curved surface form as illustrated in FIG. 4 and the angle θ formed by the tangential direction and the transfer direction of the nonwoven fabric 3 proximate the exit (at the blast opening 63Na) of the hot air is within the range of 0 to 30 degrees and more preferably this tangential direction and the transfer direction of the nonwoven fabric 3 is made close to parallel. And hereby, the hot air blasted from the blast opening 63Na is likely to flow along the surface of the nonwoven fabric 3.

As indicated with thick arrows in FIG. 4, the hot air blasted from the outgoing route blast opening 63Na comes into contact with the surface (lower side face in FIG. 4) of the nonwoven fabric 3 with a velocity component in the downstream side along the transfer direction, and thereafter flows along this surface as it is in the direction from the blast opening 63Na toward the discharge opening 63*ha*. And this hot air is discharged outside from the discharge opening 63*ha* located most downstream along the transfer direction in the outgoing route space SP62*a*. Note that there is a case where a part of the hot air is discharged outside from the exit 62*aout* of the nonwoven fabric 3.

Further in the present embodiment, some of the surrounding air (exterior of the case member 62) is sucked in to enter into the outgoing route space SP62*a* when the transferred nonwoven fabric 3 enters from the entrance 62*ain* into the interior of the case member 62. And the sucked air forms an accompanying flow which flows in the transfer direction by moving along with the transferred nonwoven fabric 3. Since this accompanying flow flows along the transfer direction, the hot air blasted from the blast opening 63Na is likely to flow along the transfer direction so as to be made to flow by this accompanying flow.

Since the hot air blasted inside the case member 62 flows to move along the surface of the nonwoven fabric 3 in this way, the situation of the hot air compressing the nonwoven fabric 3 in the thickness direction of the nonwoven fabric 3 is effectively avoided and hereby the bulk can be smoothly recovered.

Further, the wind speed value Vw (m/min) of the hot air can be made greater than the transfer speed value V3 (m/min) of the nonwoven fabric 3 by adjusting the air volume ($m^3$/min) of the hot air. And in this way, the hot air blasted from the blast opening 63Na would pass the nonwoven fabric 3 swiftly along the surface of the nonwoven fabric 3 to be discharged outside from the discharge opening 63*ha* in the end. Therefore, this hot air can easily become turbulent based on the relative speed difference between the hot air and the nonwoven fabric 3. And as a result, the heat-transfer efficiency is dramatically improved so that the nonwoven fabric 3 can be heated efficiently allowing quick bulk recovery. Further, since the fibers of the nonwoven fabric 3 are randomly loosened by the hot air turbulence, this also promotes the bulk recovery.

By the way, the wind speed value Vw (m/min) of the hot air is a value obtained by, for example, dividing the air volume ($m^3$/min) supplied to the outgoing route space SP62*a* by the sectional area (i.e., the area of the section having the transfer direction as the normal direction thereof) of the outgoing route space SP62*a*.

Further, it is preferable that the magnitude relationship between the aforementioned wind speed value Vw and the transfer speed value V3 is established along the entire transfer direction of the outgoing route space SP62*a*, however, it need not be established along the entire length thereof. In other words, the functional effect of the aforementioned turbulent state can be relished if the aforementioned magnitude relationship is established at a part of the space SP62*a*.

Here, the shape of the outgoing route blast opening 63Na is in a rectangular form having the longitudinal direction directed along the CD direction. And the dimension of the outgoing route blast opening 63Na in the CD direction is set to have the same value as the dimension along the CD direction of the outgoing route space SP62*a*, however, it is not limited to such. For example the blast opening 63Na may be smaller. But, it is preferable that the dimension along the CD direction of the blast opening 63Na is greater than the width dimension (dimension along the CD direction) of the nonwoven fabric 3, and thereby uneven heating along the CD direction can be suppressed.

Further in this present embodiment, the dimension (the dimension along the direction orthogonal to the dimension along the aforementioned CD direction, indicated as LNa in FIG. 4) along the crosswise direction of the blast opening 63Na can be set along a wide area. In other words, the sectional area (the product of the lengthwise direction dimension and the crosswise direction dimension of the blast opening 63Na) of the blast opening 63Na can be freely changed.

<Air Volume ($m^3$/min) Adjustment of Hot Air>

As aforementioned, the bulk recovery apparatus 20 according to the present embodiment realizes an effective and quick bulk recovery by making the wind speed value Vw (m/min) of the hot air at the interior of the case member 62 of the heating unit 61 to be greater than the transfer speed value V3 (m/min) of the nonwoven fabric 3 and become turbulent. In order therefor, the hot air volume ($m^3$/min) blasted out from the blast openings 63Na and 63Nb are adjusted accordingly to make Vw greater than V3. By the way, this hot air volume need to be adjusted to an appropriate volume and does not work well by simply setting to the air volume so to satisfy Vw>V3. This is because a normal bulk recovery may not be achieved when the hot air volume is too large depending on the material of the nonwoven fabric 3 being the target of bulk recovery.

For example, when the core member of the core-sheath structured composite fiber which configures the nonwoven fabric 3 is PET (polyethylene terephthalate) and the sheath member thereof is PE (polyethylene) (referred as type A nonwoven fabric), the melting point of the core member (PET) is approximately 250 degrees centigrade whereas the melting point of the sheath member (PE) is approximately 120 to 130 degrees centigrade. When the bulk recovery heating temperature for such type A nonwoven fabric is about 100 degrees centigrade, the melting point of the sheath part of the nonwoven fabric being at temperature close to the melting point would melt easily whereas the core part being far from the melting point would not. Therefore, type A nonwoven fabric would not have at least the core part stretching easily even when heated.

Meanwhile, when core member of the core-sheath structured composite fiber which configures the nonwoven fabric 3 is polypropylene (PP) and the sheath member thereof is PE (polyethylene) (referred as type B nonwoven fabric), the melting point of the core member (PP) is approximately 160 degrees centigrade whereas the melting point of the sheath member (PE) is approximately 120 to 130 degrees centigrade. When the bulk recovery heating temperature for such type B nonwoven fabrics is about 100 degrees centigrade, not only the sheath part but the core part of the nonwoven fabric 3 being at a temperature close to the melting point are likely to melt easily and so the fiber can stretch easily. Therefore, the nonwoven fabric 3 being transferred in a state under a predetermined tensile force in the heating unit 61, would allow the type B nonwoven fabric itself to be stretched easily in the transfer direction due to the stretching of the fiber.

Thus, normal bulk recovery is performed when the nonwoven fabric 3 being the target of bulk recovery is such as the type A nonwoven fabric whereas normal bulk recovery would be difficult with the nonwoven fabric itself being stretched in the transfer direction before bulk recovery is performed when the nonwoven fabric 3 is such as the type B nonwoven fabric.

In order to deal with such different nonwoven fabric in the present embodiment, the heat quantity per unit time provided to each of the outgoing route space SP62*a* and the return route space SP62*b* are adjusted by changing the hot air volume ($m^3$/min) blasted from the blast openings 63Na, 63Nb. Hereby, normal bulk recovery would be performed by appropriately heating the nonwoven fabric 3 and an effective bulk recovery can be realized by increasing the wind velocity value Vw of the hot air inside the case member 62 to be greater than the transfer speed value V3 of the nonwoven fabric 3.

The adjustment of the hot air volume is performed by the air blower 67*b*, however, there may be a case where the adjustable range is limited by the actual dimension of the blast opening from which the hot air is blasted. But in the present embodiment, a wide adjustment range can be set since the blast openings 63Na, 63Nb for the hot air are respectively provided to the wall surfaces 63*wa*, 63*wb* of the case member 62 which are along the transfer direction.

Figure 5:
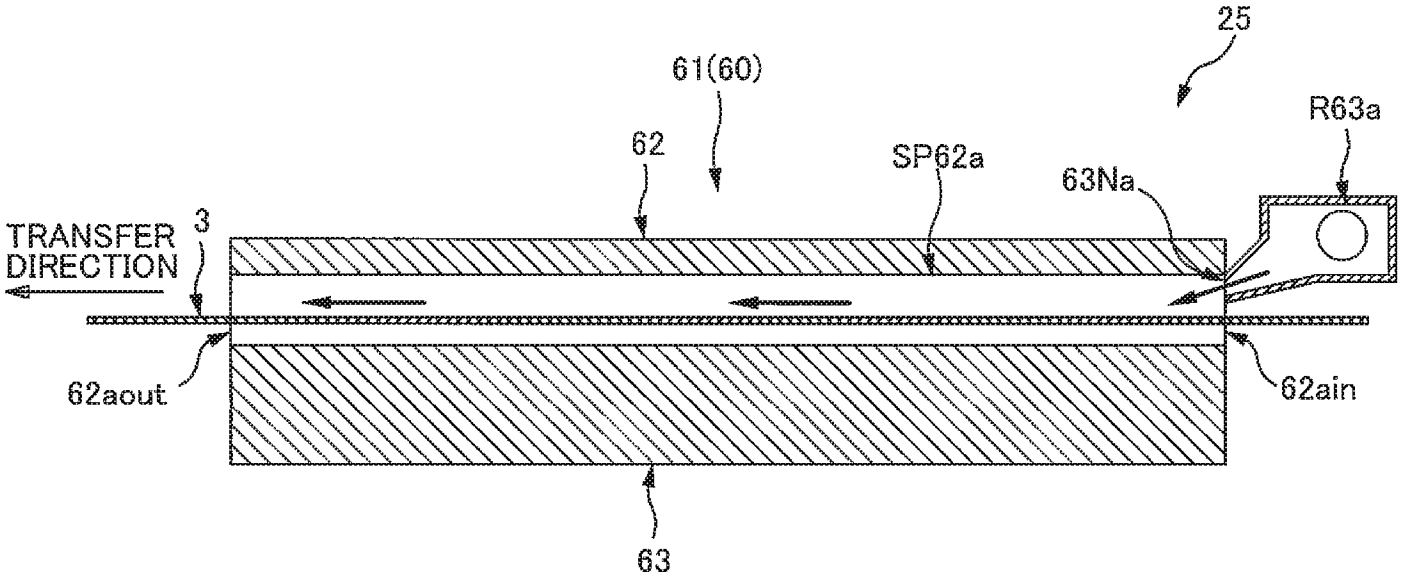
FIG. 5 is a schematic view of the heating portion 60 of the bulk recovery apparatus in a comparative example.

Here, description of the adjustment of the hot air volume with a conventional bulk recovery apparatus as a comparative example will be given. FIG. 5 is a schematic view of the heating portion 60 of the bulk recovery apparatus 25 in a comparative example. Description of only the outgoing route space SP62*a* side will be given with also FIG. 5 and description of the return route space side will be omitted.

Similar to the bulk recovery apparatus 20 according to the present embodiment, the bulk recovery apparatus 25 of the comparative example includes a transfer portion 30 (not shown in FIG. 5) and a heating portion 60. The configuration of the transfer portion 30 is substantially the same as that in the present embodiment so the description thereof will be omitted. Meanwhile, the configuration of the heating unit 61 in the heating portion 60 differs from that in the present embodiment. In the bulk recovery apparatus 25 of the comparative example, the blast opening 63Na which blasts hot air to the outgoing route space SP62*a* and the pressure chamber R63*a* are provided outside the case member 62. Specifically, the blast opening 63Na is disposed at a location of the entrance 62*ain* of the outgoing route space SP62*a*. The hot air blasted from the blast opening 63Na enters the outgoing route space SP62*a* from the entrance 62*ain* and flows along the transfer direction of the nonwoven fabric 3 as indicated with thick arrows in FIG. 5, to recover the bulk by heating the surface of the nonwoven fabric 3. Thereafter, the hot air is discharged outside from the exit 62*aout* of the outgoing route space SP62*a*.

It is important to adjust the hot air volume to be in an appropriate range in also the bulk recovery apparatus 25 of the comparative example in order to realize an effective bulk recovery of the nonwoven fabric 3. However, it would be difficult to sufficiently adjust the volume of hot air blasted from the blast opening 63Na with the configuration in FIG. 5. In the heating portion 60 in the comparative example, the dimension of the blast opening 63Na is limited to be equal or smaller than the sectional area of the entrance 62*ain* of the case member 62 due to the structure of the heating portion 60. In other words, the sectional area of the blast opening 63Na for blasting hot air is equal to or less than the sectional area (area of the section having the transfer direction along the normal direction) of the space SP62*a* through which the hot air is to flow. This blast opening having its dimension limited may not allow normal bulk recovery. For example, the narrow sectional area of the blast opening would allow the wind speed value Vw of the hot air to be excessively large when attempting to increase the wind volume so that the fiber would be blown down in the direction of the hot air flow (i.e. transfer direction of the nonwoven fabric 3) at the surface of the nonwoven fabric 3 in turn making inefficient bulk recovery. Further, the pressure would drop proximate the blast opening when attempting to increase the wind volume creating a possibility of reducing the energy efficiency and damaging the heating unit 61. Reversely, the hot air speed value Vw in the space inside the case member 62 would become smaller than the transfer speed value V3 of the nonwoven fabric 3 when the wind volume is decreased which in turn reduces the bulk recovery efficiency. In this way, it would be difficult to perform an efficient bulk recovery with the bulk recovery apparatus 25 in the comparative example having the adjustable range of the hot air volume narrowed by limiting the dimension of the blast opening.

In comparison, the bulk recovery apparatus 20 according to the present embodiment having the blast openings 63Na, 63Nb respectively provided to the wall surface along the transfer direction of the case member 62 allows easy changing of the sectional area of the above blast openings. For example, in FIG. 4, the sectional area of the blast opening 63Na can be made wider than the sectional area of SP62*a* being a space through which hot air flows along the transfer direction by setting the space LNa (i.e. width of the blast opening 63Na in the transfer direction) in the transfer direction at a part where the wall surfaces R631*a*, R632*a* come in communication with the space SP62*a*. Hereby, the adjustable range of the hot air volume can be widened so that issues as in the above described comparative example is unlikely to occur.

Further, the hot air blasted from the blast opening 63Na and into the outgoing route space SP62*a* can be quickly discharged from the discharge opening 63*ha* in the bulk recovery apparatus 20 according to the present embodiment, since a discharge opening 63*ha* is provided on the downstream side along the flow direction of the hot air. With such a configuration, hot air can flow easily along the transfer direction so that issues of the hot air residing in the space SP62*a* or the direction of the hot air flow reversing at somewhere along the way is unlikely to be faced. Therefore, hot air can be made to flow along the face of the nonwoven fabric 3 even when the hot air volume blasted from the blast opening 63Na is increased thereby allowing a smooth bulk recovery.

Other Embodiments

Hereinabove, embodiments of the present invention have been described, however, the foregoing embodiments are intended to facilitate the understanding of the present invention but not to limit the invention. And it is needless to say that modifications and improvements of the present invention are possible without departing from the scope of the invention, and equivalents thereof are also encompassed by the invention. For example, the following modifications are possible.

In the aforementioned embodiment, the nonwoven fabric 3 for top sheets 3 of pee pads 1 for pets had been exemplified as the target to be processed by the bulk recovery apparatus 20, however, it is not limited to such. For example, nonwoven fabric for top sheets of sanitary napkins and nonwoven fabric for top sheets of diapers may be the targets. Further, the target to be processed by the bulk recovery apparatus 20 is not at all limited to nonwoven fabric 3 for the top sheet 3. In other words, nonwoven fabric of materials of other components which require to be bulky may processed with the bulk recovery apparatus 20 according to the present invention.

In the aforementioned embodiment, as illustrated in FIG. 1B, a nonwoven fabric 3 having on one face a plurality of linear bumps 3*p*, 3*p* . . . had been exemplified as an example of the nonwoven fabric 3 for the top sheet 3, however, it is not limited to such. For example, nonwoven fabric of a common type, that is, nonwoven fabric having substantially flat faces on both faces thereof may do.

In the aforementioned embodiment, as illustrated in FIG. 2, the heating unit 61 of the heating portion 60 heated the nonwoven fabric 3 on both the outgoing route and the return route, however, it is not limited to such. For example, either the outgoing route blast opening 63Na or the return route blast opening 63Nb may be omitted when the bulk can be sufficiently recovered on either one of the outgoing route and the return route. Reversely, when two paths of the outgoing route and the return route are not enough for bulk recovery, a plurality of the aforementioned heating units 61, rather than one, may be provided with three or more paths heating the nonwoven fabric 3. Note that, it is preferable to provide the blast openings 63Na, 63Nb in a manner respectively corresponding to the outgoing route and the return route so that the length of the heating unit 61 in the lengthwise direction is shortened while securing a sufficient transfer pathway length for the bulk recovery of the nonwoven fabric 3.

In the aforementioned embodiment, as illustrated in FIG. 3A, the outgoing route blast opening 63Na was provided at an upstream side part along the outgoing route of the outgoing route wall surface 63*wa* and the return route blast opening 63Nb was provided at an upstream side part along the return route of the return route wall surface 63*wb*, however, it is not limited to such.

For example, the outgoing route blast opening 63Na may be provided at a downstream side part (corresponding to the "exit side part in the case member") along the outgoing route of the outgoing route wall surface 63*wa* and the return route blast opening 63Nb may be provided at a downstream side part (corresponding to the "exit side part in the case member") along the return route of the return route wall surface 63*wb*. And in such case, both blast openings 63Na, 63Nb for the outgoing route and the return route are formed such that hot air is blasted toward the upstream side along the transfer direction with an acute angle with respect to one face of the two faces of the nonwoven fabric 3. Hereby, the hot air blasted from the outgoing route blast opening 63Na comes into contact with the nonwoven fabric 3 with a component of velocity on the upstream side along the transfer direction, and flows upstream along the surface of the nonwoven fabric 3 as it is, to be finally discharged outside from the outgoing route entrance 62*ain* located most upstream in the outgoing route space SP62*a*. Further, the hot air blasted from the return route blast opening 63Nb comes into contact with the nonwoven fabric 3 with a component of velocity of the upstream side along the transfer direction, and flows upstream along the surface of the nonwoven fabric 3 as it is, to be finally discharged outside from the return route entrance 62*bin* located most upstream in the return route space SP62*b*.

In the aforementioned embodiment, a solid member which does not include space inside besides the pressure chambers R63*a*, R63*b* and the discharge openings 63*ha*, 63*hb* had been used as the material of the partitioning member 63, however, it is not limited to such. For example, hollow members including a space inside may be used for the purpose of weight reduction. For example, a member made of a combination of a stainless steel flat plate member (not shown) which forms the outgoing route wall surface 63*wa* in FIG. 3A, a stainless steel flat plate member (not shown) which forms the return route wall surface 63*wb*, and a rectangular column (not shown) which is inserted between these flat plate members to connect the flat plate members can be given as an example of a hollow member.

REFERENCE SIGNS LIST

1 pee pads for pets (absorbent article)
2 top sheet (nonwoven fabric), 3R nonwoven fabric roll,
3*a* face, 3*b* face, 3*e* circumferential edge,
3*t* groove, 3*p* bump, 3*h* through hole,
4 absorbent body, 4*c* absorbent core,
4*t*1 covering sheet, 4*t*2 covering sheet,
5 back sheet,
20 bulk recovery apparatus (embodiment), 25 bulk recovery apparatus (comparison example),
30 transfer portion,
32 transfer roller,
32*u* upstream side drive transfer roller, 32*d* downstream side drive transfer roller,
35 supply device,

60 heating portion, 61 heating unit, 62 case member,
62*ain* entrance, 62*aout* exit,
62*bin* entrance, 62*bout* exit,
63 partitioning member,
63Na blast opening, 63Nb blast opening,
63*ha* discharge opening, 63*hb* discharge opening,
63*wa* outgoing route wall surface, 63*wb* return route wall surface,
64 guide roller,
67 hot air supply device,
67*b* air blower, 67*bs* suction side part
67*h* heater, 67*ha* heater, 67*hb* heater,
67*i* impeller, 67*p* tube member, 69 recovery tube member,
SP62*a* outgoing route space, SP62*b* return route space,
R63*a* pressure chamber, R63*b* pressure chamber,
R631*a* wall surface, R632*a* wall surface

The invention claimed is:

1. An apparatus configured to recover a bulk of a nonwoven fabric by blowing hot air and heating the nonwoven fabric that is transferred in a transfer direction, said apparatus comprising:

a case member including first and second open end portions opposing each other in the transfer direction to transfer the nonwoven fabric;

a wall surface extending along the transfer direction and between the first and second open end portions of the case member;

a blast opening provided to the wall surface and configured to blast the hot air into a space inside the case member in the transfer direction or a direction opposite the transfer direction; and a discharge opening provided to the case member, arranged downstream of the blast opening in the direction in which the hot air is blasted, and configured to discharge the hot air from the space inside the case member, wherein the apparatus is configured to cause the hot air to flow from the blast opening toward the discharge opening while coming into contact with one of two faces of the nonwoven fabric in the space inside the case member, the case member has an outgoing route and a return route of a transfer path of the nonwoven fabric, and the discharge opening is positioned between the outgoing route and the return route in a direction perpendicular to the transfer direction.

2. The apparatus according to claim 1, wherein a sectional area of the blast opening is larger than a sectional area of the space inside the case member taken in the direction perpendicular to the transfer direction.

3. The apparatus according to claim 1, wherein the blast opening is positioned adjacent to the first or second open end portion of the case member, the discharge opening is positioned adjacent to the first or second open end portion of the case member, and the apparatus is configured to blast the hot air to flow from an upstream side along the transfer direction toward a downstream side along the transfer direction.

4. The apparatus according to claim 3, wherein the direction in which the hot air is blasted from the blast opening forms an angle that is 30 degrees or less with respect to the transfer direction.

5. The apparatus according to claim 4, wherein the wall surface has first and second regions configured to be in contact with the hot air, the first region is located on the downstream side along the transfer direction, the second region is located on the upstream side along the transfer direction, the first region has a curved surface convex toward the second region, and a tangential direction of the curved surface at a location of the blast opening forms the angle that is 30 degrees or less with respect to the transfer direction.

6. The apparatus according to claim 1, further comprising a hot air supply device configured to supply the hot air into the case member, wherein the hot air supply device is configured to recover the hot air discharged from the discharge opening to resupply into the case member.

7. The apparatus according to claim 1, wherein the wall surface is formed by a partitioning member inside the case member, the partitioning member divides the space inside the case member into an outgoing route space corresponding to the outgoing route of the nonwoven fabric and a return route space corresponding to the return route of the nonwoven fabric, and the partitioning member is configured to prevent the hot air from communicating between the outgoing route space and the return route space.

8. The apparatus according to claim 7, wherein the discharge opening includes a first discharge opening open into the outgoing route space in the direction perpendicular to the transfer direction, and a second discharge opening open into the return route space in the direction perpendicular to the transfer direction.

9. The apparatus according to claim 7, further comprising a pressure chamber in the partitioning member, wherein the pressure chamber is positioned upstream of the discharge opening in the transfer direction and is configured to supply the hot air to the outgoing route space or the return route space.

10. The apparatus according to claim 7, wherein the apparatus is configured to cause surrounding air, which is exterior of the case member, to be sucked from the first open end portion or the second open end portion into the outgoing route space when the nonwoven fabric is transferred to enter the case member from the first open end portion or the second open end portion, and to form an accompanying flow in the transfer direction to the hot air blasted from the blast opening.

11. The apparatus according to claim 5, wherein the angle formed between the direction in which the hot air is blasted from the blast opening and the transfer direction is in a range of 0 to 10 degrees.

12. A method of recovering a bulk of a nonwoven fabric by blowing hot air and heating the nonwoven fabric that is transferred in a transfer direction, the method comprising:

providing a case member having first and second open end portions opposing each other in the transfer direction to transfer the nonwoven fabric;

blasting the hot air in the transfer direction or a direction opposite the transfer direction into a space inside the case member from a blast opening provided to a wall surface, the wall surface extending along the transfer direction and between the first and second open end portions of the case member;

discharging the hot air from the space inside the case member from a discharge opening provided to the case member, the discharge opening being arranged downstream of the blast opening along the direction in which the hot air is blasted; and causing the hot air to flow from the blast opening toward the discharge opening while coming into contact with one of two faces of the nonwoven fabric in the space inside the case member, wherein the case member has an outgoing route and a return route of a transfer path of the nonwoven fabric, and the discharge opening is positioned between the outgoing route and the return route in a direction perpendicular to the transfer direction.

* * * * *